US008376484B2

(12) United States Patent
Benz et al.

(10) Patent No.: US 8,376,484 B2
(45) Date of Patent: Feb. 19, 2013

(54) SUPPORT ARRANGEMENT AND REFRIGERATOR PROVIDED THEREWITH

(75) Inventors: Thomas Benz, Neu-Ulm (DE); Michael Krapp, Nattheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 13/186,498

(22) Filed: Jul. 20, 2011

(65) Prior Publication Data

US 2011/0272549 A1 Nov. 10, 2011

Related U.S. Application Data

(62) Division of application No. 11/919,724, filed as application No. PCT/EP2006/061386 on Apr. 6, 2006, now Pat. No. 8,042,892.

(30) Foreign Application Priority Data

May 10, 2005 (DE) ..... 10 2005 021 538

(51) Int. Cl.
*A47B 96/02* (2006.01)

(52) U.S. Cl. ..... 312/408; 108/108

(58) Field of Classification Search ..... 108/106, 108/107, 108, 109; 211/190, 207, 193, 187; 312/128, 351, 116, 126, 408; 248/224.8, 248/225.21, 235, 250, 244
See application file for complete search history.

(56) References Cited

U.S. PATENT DOCUMENTS

| | | | | |
|---|---|---|---|---|
| 569,640 | A | 10/1896 | Hartzell | |
| 2,056,078 | A * | 9/1936 | Slater | 248/243 |
| 2,336,604 | A | 12/1943 | Edward et al. | |
| 2,703,692 | A | 3/1955 | Felix | |
| 2,729,342 | A * | 1/1956 | Saul, Jr. | 211/191 |
| 3,311,072 | A * | 3/1967 | Pattison | 108/143 |
| 3,575,484 | A * | 4/1971 | Kesling | 312/330.1 |
| 3,865,337 | A * | 2/1975 | Towfigh et al. | 248/246 |
| 4,421,289 | A | 12/1983 | Sturm | |
| 4,892,200 | A | 1/1990 | Alperson | |
| 4,901,965 | A | 2/1990 | Bowman | |
| 5,092,546 | A * | 3/1992 | Wolfbauer | 248/49 |
| 5,277,393 | A | 1/1994 | Nicholson et al. | |
| 5,388,796 | A | 2/1995 | Sullivan | |
| 6,663,204 | B2 | 12/2003 | Atalla et al. | |
| 6,675,725 | B2 * | 1/2004 | Felton et al. | 108/107 |
| 2004/0149182 | A1 * | 8/2004 | Bienick et al. | 108/108 |
| 2004/0178709 | A1 * | 9/2004 | Zimmerman | 312/404 |
| 2004/0255607 | A1 * | 12/2004 | Barmann et al. | 62/407 |
| 2008/0030114 | A1 | 2/2008 | Becke | |

FOREIGN PATENT DOCUMENTS

| | | | |
|---|---|---|---|
| CH | 477187 | A | 8/1969 |
| EP | 1443292 | A2 | 8/2004 |
| FR | 1407947 | A | 8/1965 |
| FR | 2807924 | A1 | 10/2001 |

* cited by examiner

*Primary Examiner* — James O Hansen
*Assistant Examiner* — Matthew Ing
(74) *Attorney, Agent, or Firm* — James E. Howard; Andre Pallapies

(57) ABSTRACT

A refrigerator that includes at least one vertical support that has a vertical guiding groove with a recess and a plurality of vertically staggered steps provided therein, and a horizontal support provided with a peg engaged into the recess of the guiding groove. In the interlocked position of the horizontal support, the peg rests on one of the steps and presses against a first wall of the vertical support from which the steps protrude. A contact surface of the horizontal support presses against a second wall of the vertical support, the second wall being arranged opposite to the first wall. The contact surface and the steps are staggered in the direction of the width of the walls, the steps being located in a lower position in the recess than the contact surface.

9 Claims, 5 Drawing Sheets

SUPPORT ARRANGEMENT AND REFRIGERATOR PROVIDED THEREWITH

CROSS-REFERENCE OF RELATED APPLICATIONS

This application is a Divisional, under 35 U.S.C. §121, of U.S. application Ser. No. 11/919,724, filed Oct. 30, 2007, now U.S. Pat. No. 8,042,892 issued Oct. 25, 2001, which is a U.S. national stage application under 35 U.S.C. §371 of PCT/EP2006/061386 filed Apr. 6, 2006, which designated the United States; this application also claims the priority, under 35 U.S.C. §119, of German Patent Application No. 10 2005 021 538.6 filed May 10, 2005.

BACKGROUND OF THE INVENTION

The present invention relates to a support arrangement comprising at least one vertical support that has a vertical guiding groove and a plurality of vertically staggered latching steps, and a horizontal support comprising a pin that engages in the guiding groove and a latching step, which, by swiveling the horizontal support about an axis defined by the pin, can engage with and disengage from the latching steps of the vertical support. A support arrangement of this kind, or a refrigerator in which it is used, is known from DE101 45 141A1.

One problem with this known support arrangement is that in order not to block the mobility of the horizontal support the latching steps of the vertical support are not allowed to project very far. If when displaced the horizontal support loses its hold this results in the risk of it being able to fall a relatively long way without engaging in latching steps in the vertical support again.

BRIEF SUMMARY OF THE INVENTION

The object of the present invention is to disclose a support arrangement comprising at least one vertical support and a horizontal support suspended therefrom, in which the risk of falling without engagement is reduced.

The object is achieved by a support arrangement comprising at least one vertical support that has a vertical guiding groove with an undercut and a plurality of vertically staggered latching steps provided therein, and a horizontal support provided with a pin that engages in the undercut of the guiding groove, in the latched position of the horizontal support the pin resting on one of the latching steps and pressing against a first wall of the vertical support from which the latching steps protrude, and a contact surface of the horizontal support pressing against a second wall of the vertical support that opposes the first wall, which is characterized in that the contact surface and the latching steps are staggered in the width direction of the walls and the latching steps are located in a lower position in the undercut than the contact surface. Whereas in the conventional support arrangement, cited above, the latching steps and the contact surfaces align with each other, the inventive offset between the two means that the pin can be made narrower and therefore even wide latching steps, which offer greater security against slipping, can pass upwards or downwards without difficulties.

According to a first embodiment the first wall is a back wall of the guiding groove which opposes an inlet slot thereof, and the contact surface is formed on a pin which engages in the undercut.

According to a second preferred embodiment the first wall is conversely a front wall of the guiding groove that is adjacent to an inlet slot, and the contact surface touches the back wall outside of the undercut. This has the advantage that the guiding groove can be made narrower than in the first embodiment but has the same effect.

To simplify production of the support arrangement the latching steps are preferably formed on an insert that is inserted in the guiding groove. The guiding groove can then be produced in particular as an extruded profile with a strictly constant cross-section.

To support the latching steps the insert preferably comprises a rod from which the latching steps protrude and which runs in a region of the undercut that is remote from an inlet slot of the guiding groove.

The latching steps can extend over one to two third(s) of the spacing between the first and second walls.

To secure latching of the horizontal support the latching steps expediently comprise a concave upper side.

To simplify the height adjustment of the horizontal support the latching steps preferably have a lower side that runs obliquely downwards toward the first wall.

A single recess in a front wall, which is adjacent to the inlet slot, of the guiding groove, through which recess the pin of the horizontal support can engage in or disengage from the undercut, is sufficient to introduce the horizontal support into the guiding groove or to remove it therefrom.

BRIEF DESCRIPTION OF THE DRAWINGS

Further features and advantages of the invention will become clear with the aid of the following description with reference to the accompanying figures, in which.

DETAILED DESCRIPTION OF EXEMPLARY EMBODIMENTS OF THE PRESENT INVENTION

Figure 1:
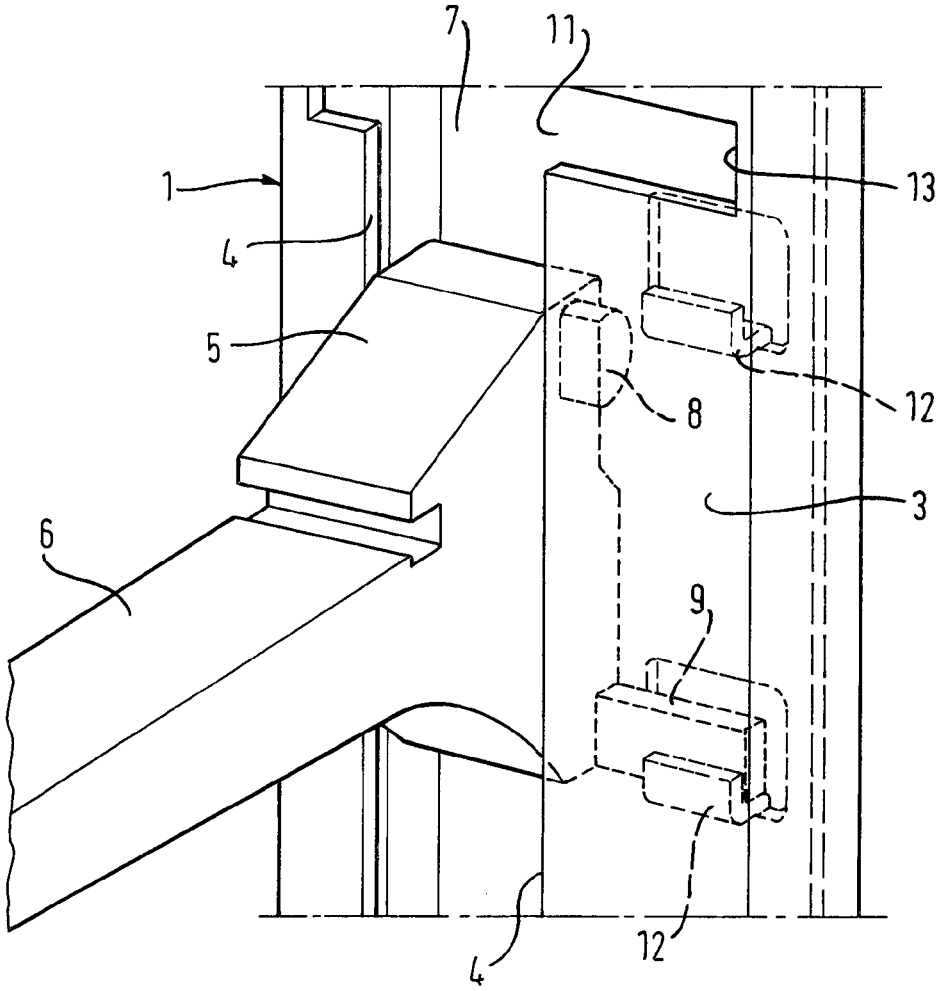
FIG. 1 shows a detail of a vertical support and a horizontal support respectively according to a first embodiment of the invention in a mutually latched position, viewed from the front of the vertical support.
Figure 2:
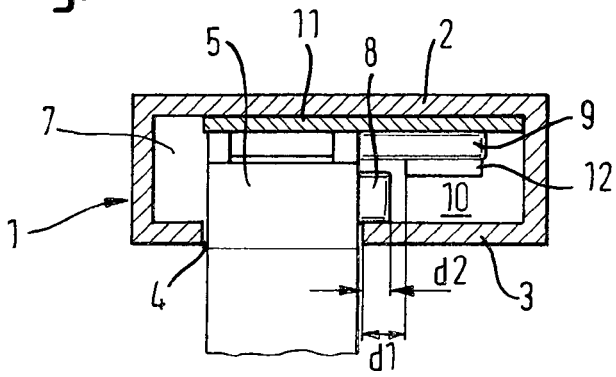
FIG. 2 shows a horizontal section through the support arrangement of FIG. 1.

FIGS. 1 and 2 show a first embodiment of the inventive support arrangement in a perspective partial view and in a horizontal section respectively. The support arrangement comprises a vertical support 1 which is provided for assembly on or is submerged in a back wall of an inner container of a refrigerator. The vertical support 1 is an extruded profile made of steel or aluminum and with a flat, rectangular cross-section, comprising a back wall 2 which forms a wide side of the rectangular cross-section and, opposing the back wall 2, a front wall 3 and an inlet slot 4 through which a head 5 of a horizontal support 6 engages in an undercut guiding groove 7 of the vertical support. One short and one long pin 8 and 9 respectively project from the head 5 into the undercut 10 of the guiding groove 7.

A strong metal sheet 11, from which latching steps 12 are notched at regular intervals inside the undercut 10, extends along the back wall 2 of the vertical support. The part of the metal sheet 11 extending behind the inlet slot 4 is smooth, so all of the vertical support appears smooth and even from the outside. The long pin 9 of the horizontal support 6 rests on one of the latching steps 12. The latching steps 12 maintain a spacing d1 from the edge of the inlet slot 4 which is greater than the length d2 of the short pin 8. The short pin 8 therefore cannot be submerged so deep into the undercut 10 that it touches a latching step 12 and could interlock therewith. The long pin 9 presses against the back wall 2 and the short pin 8 against the front wall 5 under the load of the arm of the horizontal support that projects from the guiding groove.

To hang the horizontal support 6 on a different latching step 12 or to remove it via a recess 13 in the front wall 3, it is initially sufficient to raise it, while retaining its spatial orientation, until the long pin 9 abuts under the next-higher latching step 12. The support 6 can accordingly be pivoted about the short pin 8, so the long pin 9 moves toward the front wall 3 and can thus pass the constriction between the latching step 12 and the front wall 3. The latching steps 12 can therefore easily extend between front and back walls over one to two third(s) of the depth of the guiding groove 7 without this restricting the mobility of the horizontal support 6. The great width of the latching steps 12 makes it almost impossible for the long pin 9 to pass a latching step in free fall however.

Figure 3:
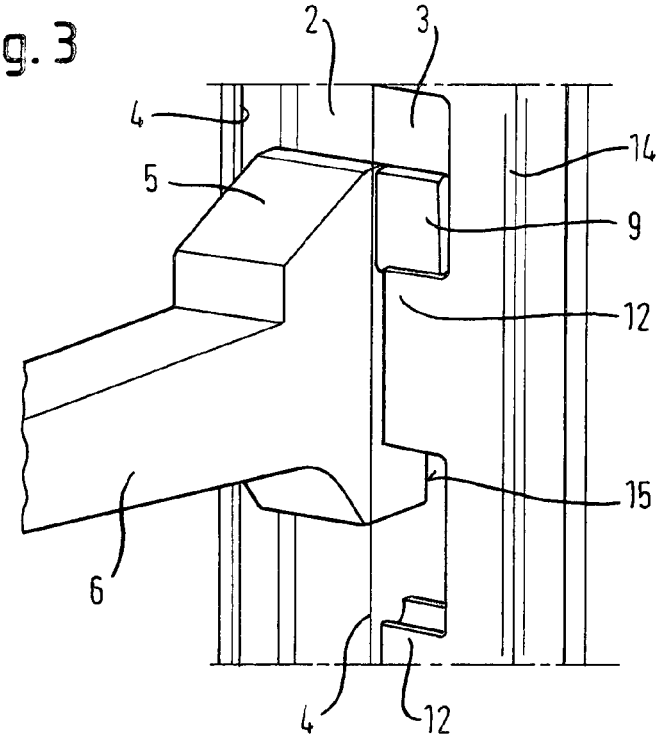
FIG. 3 shows a perspective partial view of a support arrangement according to a second embodiment of the invention, viewed from the front of the vertical support.
Figure 4:
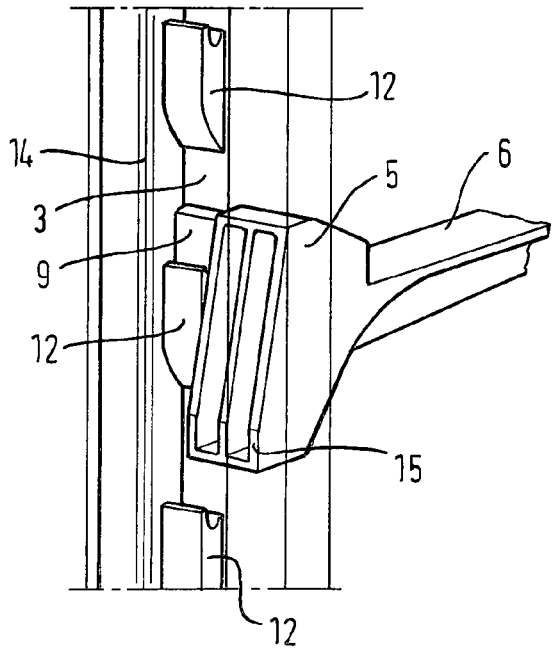
FIG. 4 shows a partial view of the second embodiment, viewed from the back of the vertical support.
Figure 5:
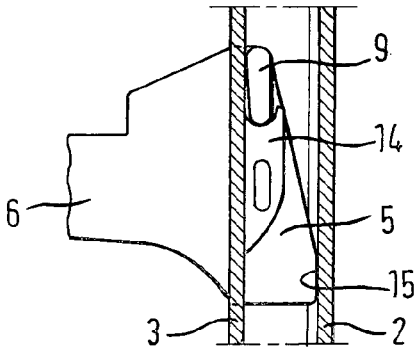
FIG. 5 shows a vertical section through the support arrangement according to the second embodiment.

A second embodiment of the invention is shown in perspective views in FIGS. 3 and 4 and in a vertical section in FIG. 5. The vertical support 1 substantially has the same cross-sectional shape as in the first embodiment here and is not shown in cross-section again therefore. Instead of the metal sheet 11 that fills the back wall 2, a rod 14 made of plastics material is provided as the support for the latching steps 12 and fills a region of the undercut 10, which is remote from the inlet slot 4, throughout its depth between front and back walls 3, 2. The latching steps 12 project from the rod in a lateral direction, toward the inlet slot 4, so as to rest against the front wall 3.

The head 5 of the horizontal support 6 that engages in the guiding groove 7 has only a single pin 9 in this case which in its function of supporting the support 6 on the latching steps 12 matches the long pin in the first embodiment, but in contrast thereto rests against the front wall 3. A projection in the lower region of the head 5 forms a contact surface 15 which supports the horizontal support 6 on a region of the back wall 2 that aligns with the inlet slot 4.

Figure 6:
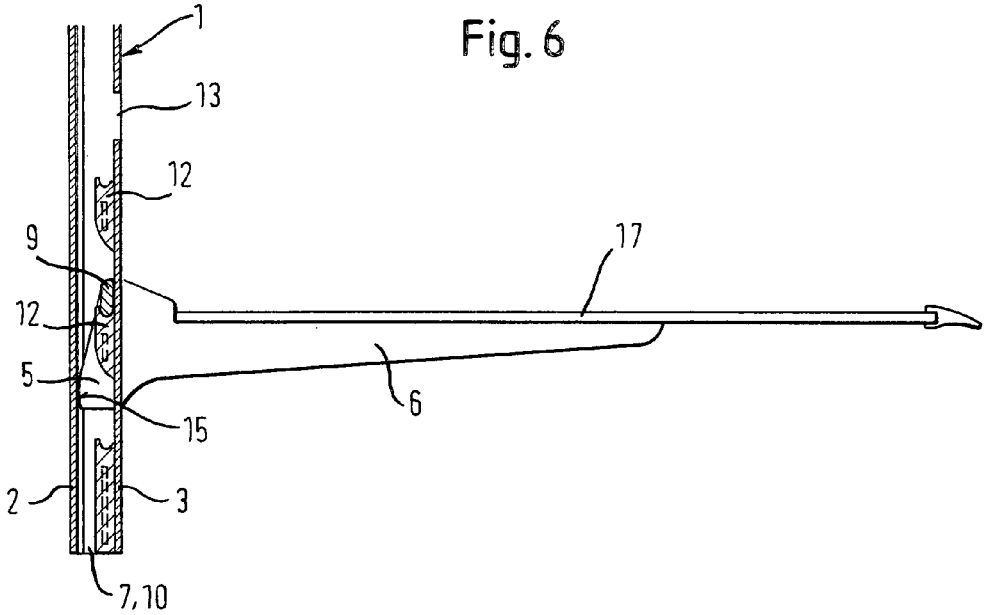
FIG. 6 shows a further vertical section through the support arrangement of the second embodiment in the latched state.
Figure 7:
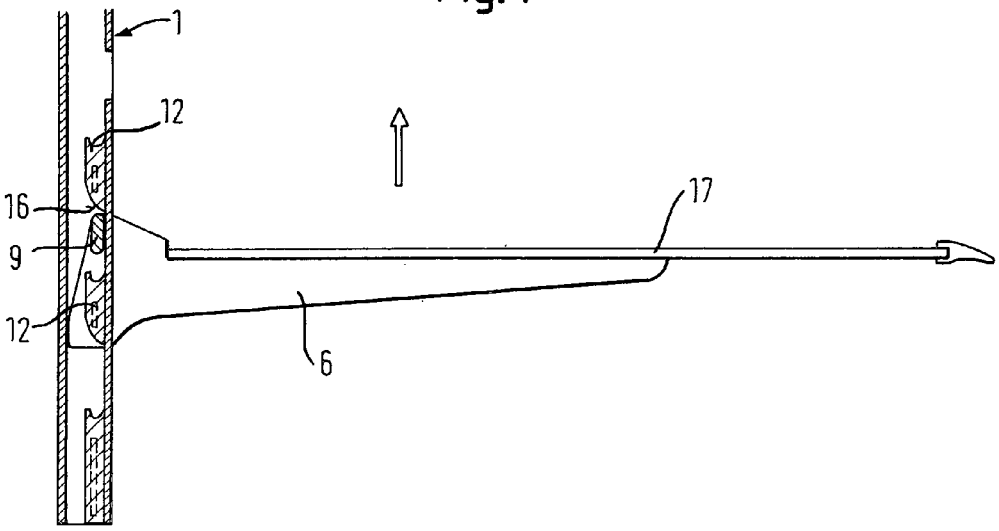
FIG. 7 shows a view analogous to FIG. 6 in which the horizontal support is raised from its latching step.

FIGS. 6 to 10 illustrate the process of adjusting the level of or removing the horizontal support 6 according to the second embodiment. FIG. 6, like FIG. 5, shows the horizontal support 6 in the latched position but in its full length and with a compartment base plate 17 that it holds. The pin 9 of the support 6 engages in the concave upper side of a latching step 12 and presses against the front wall 3 while below it the contact surface 15 presses against the back wall 2. As already described for the first embodiment and shown in detail in FIG. 7, the horizontal support 6 can firstly be raised parallel until its pin 9 touches the lower side 16 of the next-higher latching step 12.

Figure 8:
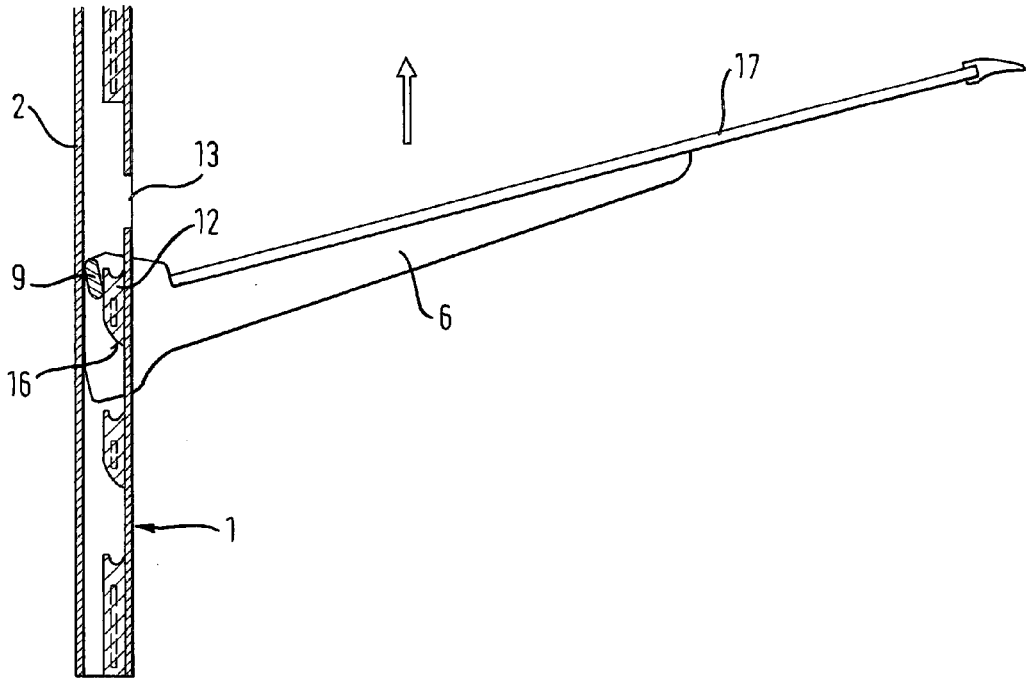
FIG. 8 shows a view analogous to FIG. 6 in which the horizontal support is capable of passing a latching step.
Figure 9:
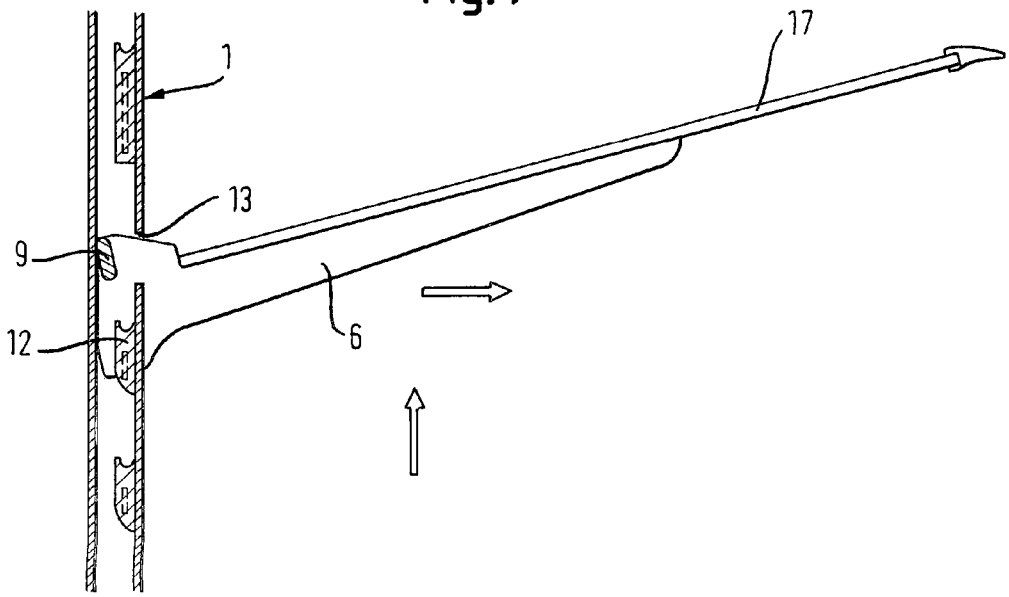
FIG. 9 shows a view analogous to FIG. 6 in which the pin of the horizontal support is located at the level of a recess in the front wall of the vertical support.
Figure 10:
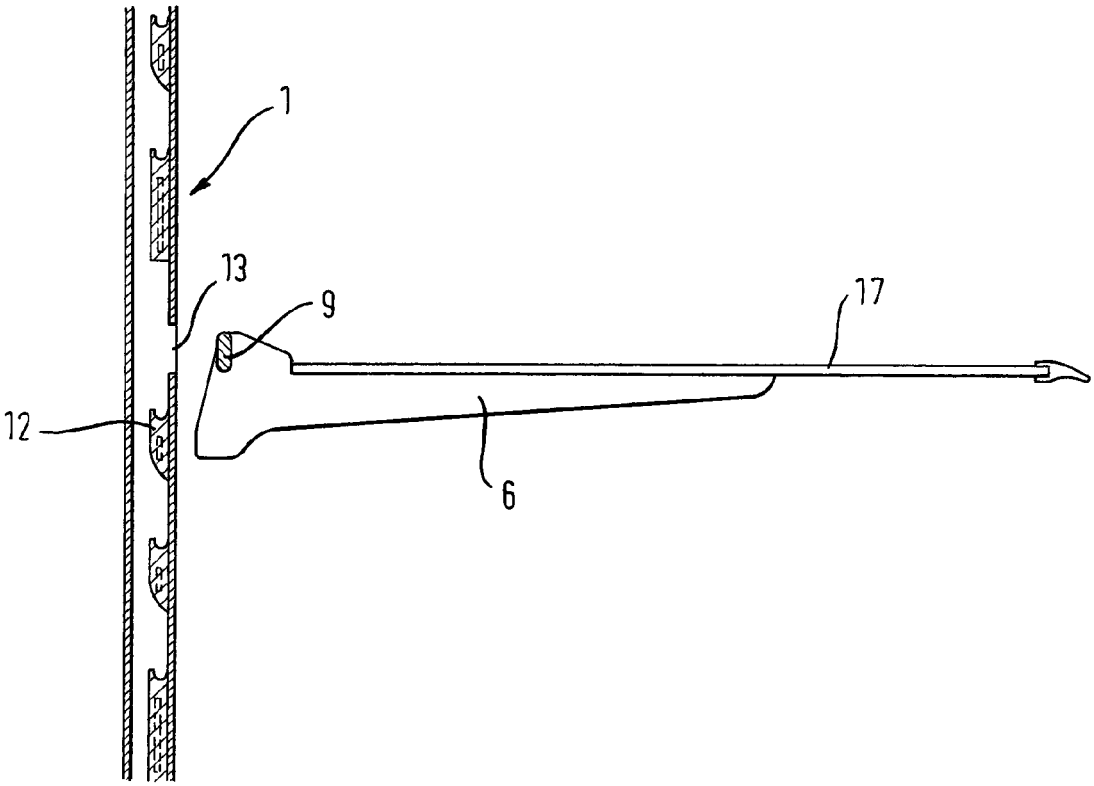
FIG. 10 shows the two supports separated from each other.

To raise the support 6 further it is necessary to tilt it. For this tilting movement the support 6 is led through the oblique lower side 16 which pushes the pin 9 against the back wall 2 without a user who is handling the support 6 having to be conscious of the need for tilting. In this thus swiveled position the pin 9 can pass the next-higher latching step 12, as shown in FIG. 8.

By reverse swiveling into the horizontal and renewed lowering the support could accordingly be hooked into the next-higher latching step 12.

A recess 13, which can pass the pin 9, is located above this latching step in the front wall 3. If the support 6 has reached the level shown in FIG. 9, in which the pin 9 opposes the recess 13, the horizontal support 6 can be detached from the vertical support 1 by pulling up.

The support 6 can be re-fitted using the same movements in the reverse order.

What is claimed is:

1. A support assembly comprising:

a.) a vertical track component having a back side structure, a generally planar first front structure and a generally planar second front structure, the first front structure and the second front structure being spaced from the back side structure as viewed in a depth direction perpendicular to a vertical direction and the first front structure and the second front structure being spaced from one another as viewed in a width direction perpendicular to both the depth direction and the vertical direction, the back side structure, the first front structure, and the second front structure together delimiting a guide groove, the guide groove having an inlet slot that is delimited by the spacing between the first front structure and the second front structure, and the second front structure extending partially over the guide groove in the width direction so as to form an undercut between the second front structure and the back side structure;

b.) a plurality of inter-engagement steps, each inter-engagement step being formed with a curved upwardly facing trough and extending in the depth direction into the undercut, the inter-engagement steps being arranged each at a vertical offset from the preceding inter-engagement step such that the inter-engagement steps are vertically staggered from one another with the inter-engagement steps each having a lower side that extends obliquely upwardly toward the back side structure;

c.) a rod for supporting the inter-engagement steps, the rod and a separate sidewall each extending between the second front structure and the back side structure with the inter-engagement steps extending laterally from the rod;

d.) a horizontal support component releasably engageable with the inter-engagement steps such that the horizontal support component can be releasably secured at selected vertical locations along the vertical track component to extend horizontally relative thereto, the horizontal support component having a body portion having a first generally planar contact surface and a second generally planar contact surface extending obliquely away from the first generally planar contact surface, and a single vertically elongate engagement projection generally oval in cross section with a curved bottom portion for mated receipt in the trough of the inter-engagement step, a portion of the engagement projection being adjacent to and flush with the second generally planar contact surface, the body portion extending horizontally outwardly relative to the vertical track component, the engagement projection extending perpendicularly from the body portion in the width direction and extending into the undercut of the guide groove and, in an engaged position of the horizontal support component, the engagement projection engaging a respective one of the inter-engagement steps in an engagement manner wherein the curved portion of the projection is received in the trough of the inter-engagement step and pressing against a surface of the second front structure, and the contact surface of the horizontal support component pressing a surface of the back side structure, whereby the engagement of the engagement projection with the inter-engagement step and the pressing contacts of the engagement projection with the second front structure, and of the contact surface of the horizontal support component against the back side structure together releasably secure the horizontal support component to the vertical track component, and, at each respective vertical position at which the horizontal support component is releasably secured to the vertical track component, the contact surface of the horizontal support component makes pressing contact against the surface of the back side structure at a location that is offset in the width direction from the locations of the inter-engagement steps of the vertical track component;

wherein the contact surface is formed by the endmost surface of the horizontal support component and wherein the engagement projection of the horizontal support component and the contact surface of the horizontal support component are formed at a spacing from one another as viewed in the depth direction with the contact surface of the horizontal support component being in abutment with the back side support of the vertical track component in an engaged position of the horizontal support component, and the engagement projection of the horizontal support component is in abutment with the second front structure and the inter-engagement steps; and wherein during vertical adjustment of the horizontal support component the obliquely extending surface of the inter-engagement step leads the engagement projection toward the back side structure for contact of the engagement projection and the second planar contact surface with the back side structure for stability during vertical movement of the horizontal support component.

2. The support assembly as claimed in claim 1, wherein, in an engaged position of the horizontal support component, the engagement projection of the horizontal support component is higher than the contact surface of the horizontal support component.

3. The support assembly as claimed in claim 1, wherein the inter-engagement steps are formed on an inner wall of the rod adjacent the guide groove.

4. The support assembly as claimed in claim 1, wherein the inter-engagement steps each have a concave upper side.

5. The support assembly as claimed in claim 1, wherein the inter-engagement steps each have a lower side that runs obliquely downwards toward the respective surface of the support assembly that the engagement projection of the horizontal support component presses against.

6. The support assembly as claimed in claim 1, wherein the engagement projection of the horizontal support component and the contact surface of the horizontal support component are formed at a spacing from one another as viewed in the depth direction with the contact surface of the horizontal support component being more proximate to the back side structure of the vertical track component in an engaged position of the horizontal support component than the engagement projection of the horizontal support component.

7. The support assembly as claimed in claim 1 wherein the engagement projection is mounted adjacent the horizontal support component for simultaneous contact with both the inter-engagement member and the second front surface.

8. A refrigerator comprising a heat-insulating housing delimiting an interior and a support assembly disposed in the interior, the support assembly including:

a.) a vertical track component having a back side structure, a generally planar first front structure and a generally planar second front structure, the first front structure and the second front structure being spaced from the back side structure as viewed in a depth direction perpendicular to a vertical direction and the first front structure and the second front structure being spaced from one another as viewed in a width direction perpendicular to both the depth direction and the vertical direction, the back side structure, the first front structure, and the second front structure together delimiting a guide groove, the guide groove having an inlet slot that is delimited by the spacing between the first front structure and the second front structure, and the second front structure extending partially over the guide groove in the width direction so as to form an undercut between the second front structure and the back side structure;

b.) a plurality of inter-engagement steps, each inter-engagement step being formed with a curved upwardly facing trough and extending in the depth direction into the undercut, the inter-engagement steps being arranged each at a vertical offset from the preceding inter-engagement step such that the inter-engagement steps are vertically staggered from one another with the inter-engagement steps each having a lower side that extends obliquely upwardly toward the back side structure;

c.) a rod for supporting the inter-engagement steps, the rod and a separate sidewall each extending between the second front structure and the back side structure with the inter-engagement steps extending laterally from the rod;

d.) a horizontal support component releasably engageable with the inter-engagement steps such that the horizontal support component can be releasably secured at selected vertical locations along the vertical track component to extend horizontally relative thereto, the horizontal support component having a body portion having a first generally planar contact surface and a second generally planar contact surface extending obliquely away from the first generally planar contact surface, and a single vertically elongate engagement projection generally oval in cross section with a curved bottom portion for mated receipt in the trough of the inter-engagement step, a portion of the engagement projection being adjacent to and flush with the second generally planar contact surface, the body portion extending horizontally outwardly relative to the vertical track component, the engagement projection extending perpendicularly from the body portion in the width direction and extending into the undercut of the guide groove and, in an engaged position of the horizontal support component, the engagement projection engaging a respective one of the inter-engagement steps in an engagement wherein the curved portion of the projection is received in the trough of the inter-engagement step and pressing against a surface of the second front structure, and the contact surface of the horizontal support component pressing a surface of the back side structure, whereby the engagement of the engagement projection with the inter-engagement step and the pressing contacts of the engagement projection with the second front structure, and of the contact surface of the horizontal support component against the back side structure together releasably secure the horizontal support component to the vertical track component, and, at each respective vertical position at which the horizontal support component is releasably secured to the vertical track component, the contact surface of the horizontal support component makes pressing contact against the surface of the back side structure at a location that is offset in the width direction from the locations of the inter-engagement steps of the vertical track component;

wherein the contact surface is formed by the endmost surface of the horizontal support component and wherein the engagement projection of the horizontal support component and the contact surface of the horizontal support component are formed at a spacing from one another as viewed in the depth direction with the contact surface of the horizontal support component being in abutment with the back side support of the vertical track component in an engaged position of the horizontal support component, and the engagement projection of the horizontal support component is in abutment with the second front structure and the inter-engagement steps; and wherein during vertical adjustment of the horizontal support component the obliquely extending surface of the inter-engagement step leads the engagement projection toward the back side structure for contact of the engagement projection and the second planar contact surface with the back side structure for stability during vertical movement of the horizontal support component.

9. A support assembly for disposition within a refrigerator, the support assembly comprising at least one vertically-oriented support rail formed as a channel and including a front wall having a front inner surface and a rear wall having a rear inner surface disposed oppositely from the front inner surface, the front inner surface and the rear inner surface defining an inner rail space therebetween, the support rail being formed with a guide groove and at least one access opening in the front wall for access to the inner rail space; a plurality of latching steps projecting into the inner rail space, the latching steps being adjacent the guide groove and vertically spaced from the at least one access opening, the latching steps being formed with an upwardly directed trough and a lower surface extending obliquely upwardly toward the rear wall; a rod for supporting the latching steps, the rod and a separate sidewall each extending between the front wall and the rear wall with the latching steps extending laterally from the rod;

and a horizontal support member for mounting to the support rail at a selected vertical disposition therealong, the horizontal support member including a head, an elongate body extending outwardly from the head, a single vertically elongate engagement projection extending laterally away from the head the vertically elongate engagement projection being generally oval in cross section with a curved bottom portion for mated receipt in the trough of the inter-engagement step, a generally vertically extending planar first contact surface, a generally planar second contact surface extending from the projection to the first contact surface, the projection being vertically and horizontally spaced from the first contact surface, adjacent and substantially flush with a portion of the second contact surface and sized to fit through the access opening, with the horizontal spacing being approximately the depth of the inner rail space, wherein when the horizontal support member is mounted to the vertical support rail, the head extending into the inner rail space, the projection rests in abutment with a latching step and the first inner wall while the contact surface is in abutment with the rear inner surface; and wherein during vertical adjustment of the horizontal support component the obliquely extending surface of the latching step leads the engagement projection toward the rear wall for contact of the engagement projection and the second contact surface with the rear wall for stability during vertical movement of the horizontal support component.

* * * * *